US012655994B2

(12) United States Patent
Bandiwad et al.

(10) Patent No.: US 12,655,994 B2
(45) Date of Patent: Jun. 16, 2026

(54) ADAPTIVE CHIMNEY DUCT

(71) Applicant: WHIRLPOOL CORPORATION, Benton Harbor, MI (US)

(72) Inventors: Lingaraj I. Bandiwad, Savanur (IN); Jakub Buczkowski, Kielczow (PL); Ashish Sharadrao Kadam, Maharashtra (IN); Luca Zilio, Biandronno (IT)

(73) Assignee: Whirlpool Corporation, Benton Harbor, MI (US)

( * ) Notice: Subject to any disclaimer, the term of this patent is extended or adjusted under 35 U.S.C. 154(b) by 502 days.

(21) Appl. No.: 18/124,803

(22) Filed: Mar. 22, 2023

(65) Prior Publication Data

US 2024/0318832 A1 Sep. 26, 2024

(51) Int. Cl.
*F24C 15/32* (2006.01)

(52) U.S. Cl.
CPC ..... *F24C 15/32* (2013.01)

(58) Field of Classification Search
CPC ..... F24C 15/32; F24C 15/2007
USPC ..... 126/21 R
See application file for complete search history.

(56) References Cited

U.S. PATENT DOCUMENTS

| | | | | |
|---|---|---|---|---|
| 4,934,337 | A | 6/1990 | Falk | |
| 5,429,116 | A | 7/1995 | Brown | |
| 7,468,496 | B2 | 12/2008 | Marchand | |
| 2008/0110879 | A1 * | 5/2008 | Marchand | F24C 15/2007 219/757 |
| 2008/0264906 | A1 * | 10/2008 | Kozar | H01H 9/342 218/157 |
| 2019/0368746 | A1 * | 12/2019 | Armstrong | F24C 15/2042 |

FOREIGN PATENT DOCUMENTS

| | | | | |
|---|---|---|---|---|
| BR | MU8700481 | U2 | 12/2008 | |
| BR | MU8801926 | U2 | 5/2010 | |
| CN | 112240585 | A | 1/2021 | |
| DE | 10202132 | B4 | 7/2011 | |
| EP | 2372254 | A1 * | 10/2011 | F24C 15/2007 |
| ES | 2229852 | A1 | 4/2005 | |
| KR | 950033880 | U | 12/1995 | |
| KR | 2012073601 | A * | 7/2012 | F24C 15/32 |
| WO | WO-2016087180 | A1 * | 6/2016 | F24C 15/2007 |
| WO | WO-2018024561 | A1 * | 2/2018 | F24C 15/2007 |

OTHER PUBLICATIONS

Korean to English machine translation of KR_2012073601_A.*

* cited by examiner

*Primary Examiner* — Michael G Hoang
*Assistant Examiner* — Elizabeth Ann Laughlin
(74) *Attorney, Agent, or Firm* — Price Heneveld LLP

(57) ABSTRACT

A cooking appliance that includes a body. A cavity housing is disposed in the body and defines a cooking cavity. A self-adjusting chimney duct assembly is disposed in a space defined between the body and the cavity housing. The chimney duct assembly includes a chimney base. An inlet is defined on a bottom section of the chimney base. A base flange is coupled to the chimney base. The base flange biases the chimney base towards the cavity housing. A chimney top cover is disposed over and operably coupled to the chimney base. An outlet is defined between the chimney base and the chimney top cover. The inlet and the outlet are in fluid communication with the cooking cavity for venting. A cover flange is coupled to the chimney top cover. The cover flange biases the chimney top cover towards the body.

20 Claims, 8 Drawing Sheets

ADAPTIVE CHIMNEY DUCT

BACKGROUND OF THE DISCLOSURE

The present disclosure generally relates to a chimney duct assembly, and more specifically, to an adaptive chimney duct assembly for an appliance.

SUMMARY OF THE DISCLOSURE

According to one aspect of the present disclosure, a cooking appliance includes a body and a cavity housing disposed in the body. The cavity housing defines a cooking cavity. A self-adjusting chimney duct assembly is disposed in a space defined between the body and the cavity housing. The chimney duct assembly includes a chimney base. An inlet is defined on a bottom section of the chimney base. A base flange is coupled to the chimney base. The base flange biases the chimney base towards the cavity housing. A chimney top cover is disposed over and operably coupled to the chimney base. An outlet is defined between the chimney base and the chimney top cover. The inlet and the outlet are in fluid communication with the cooking cavity for venting. A cover flange is coupled to the chimney top cover and biases the chimney top cover towards the body.

According to another aspect of the present disclosure, a cooking appliance ventilation system includes a body with a top section. A cavity housing is disposed within the body and includes a top portion. A space is defined between the top portion of the cavity housing and the top section of the body. A chimney duct assembly is disposed in the space. The chimney duct assembly includes a chimney base with a sidewall that defines an interior. An inlet is defined by a bottom section of the chimney base. A first pair of biasing flanges are coupled to the chimney base and extend outward from the sidewall. The first pair of biasing flanges operably engage with the body and bias the chimney base towards the cavity housing. A chimney top cover is disposed over and operably coupled to the chimney base. The chimney top cover includes a covering portion and a wall portion. An outlet is defined between the chimney base and the chimney top cover. The outlet is in fluid communication with the inlet. A second pair of biasing flanges are coupled to the wall portion and extend inward from the wall portion. The second pair of biasing flanges bias the chimney top cover towards the body and away from the chimney base to adjust to a height of the space between the cavity housing and the body.

According to yet another aspect of the present disclosure, a ventilation system for a cooking appliance includes a body with a top section. A cavity housing is disposed within the body. The cavity housing has a top portion and defines a cooking cavity. A chimney duct assembly is disposed between the cavity housing and the body. The chimney duct assembly includes a chimney base with a sidewall that extends from a bottom section. An inlet is defined by the bottom section and is configured to align with a cooking cavity outlet that is defined by the cavity housing to permit an airflow from the cooking cavity. The chimney base includes upper biasing flanges that extend outward from the sidewall. The upper biasing flanges operably engage with the top section and bias the chimney base towards the cavity housing. A chimney cover is disposed over and operably coupled to the chimney base. The chimney cover includes a covering portion and a wall portion extending from the covering portion. Lower biasing flanges extend inward from the wall portion. The lower biasing flanges bias the chimney cover towards the top section. A venting outlet is defined between the chimney base and the chimney top cover. The outlet is in fluid communication with the cooking cavity outlet and the inlet to permit venting of the cooking cavity.

These and other features, advantages, and objects of the present disclosure will be further understood and appreciated by those skilled in the art by reference to the following specification, claims, and appended drawings.

Figure 1:
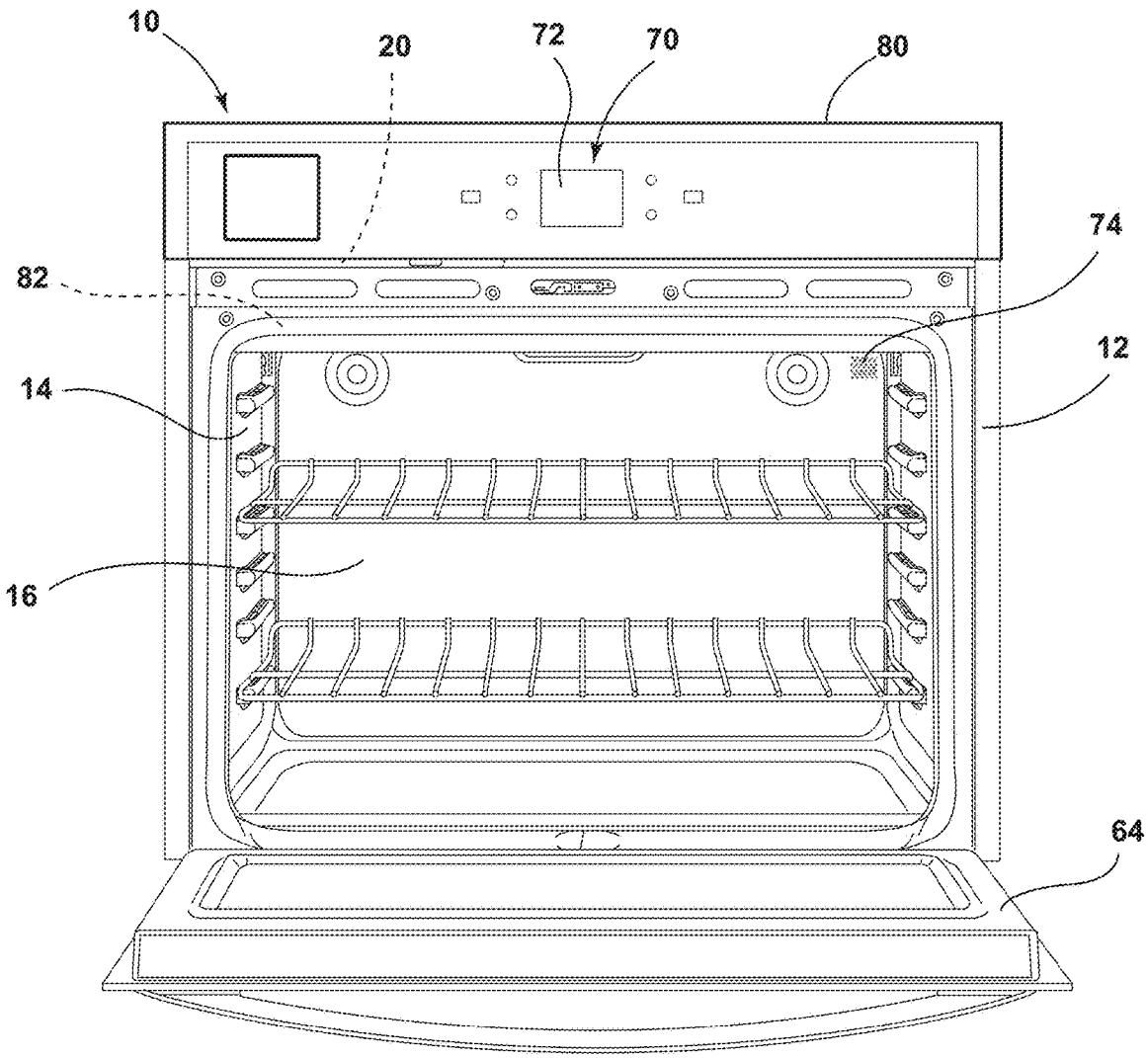
FIG. 1 is a front perspective view of a cooking appliance, according to the present disclosure.
Figure 2:
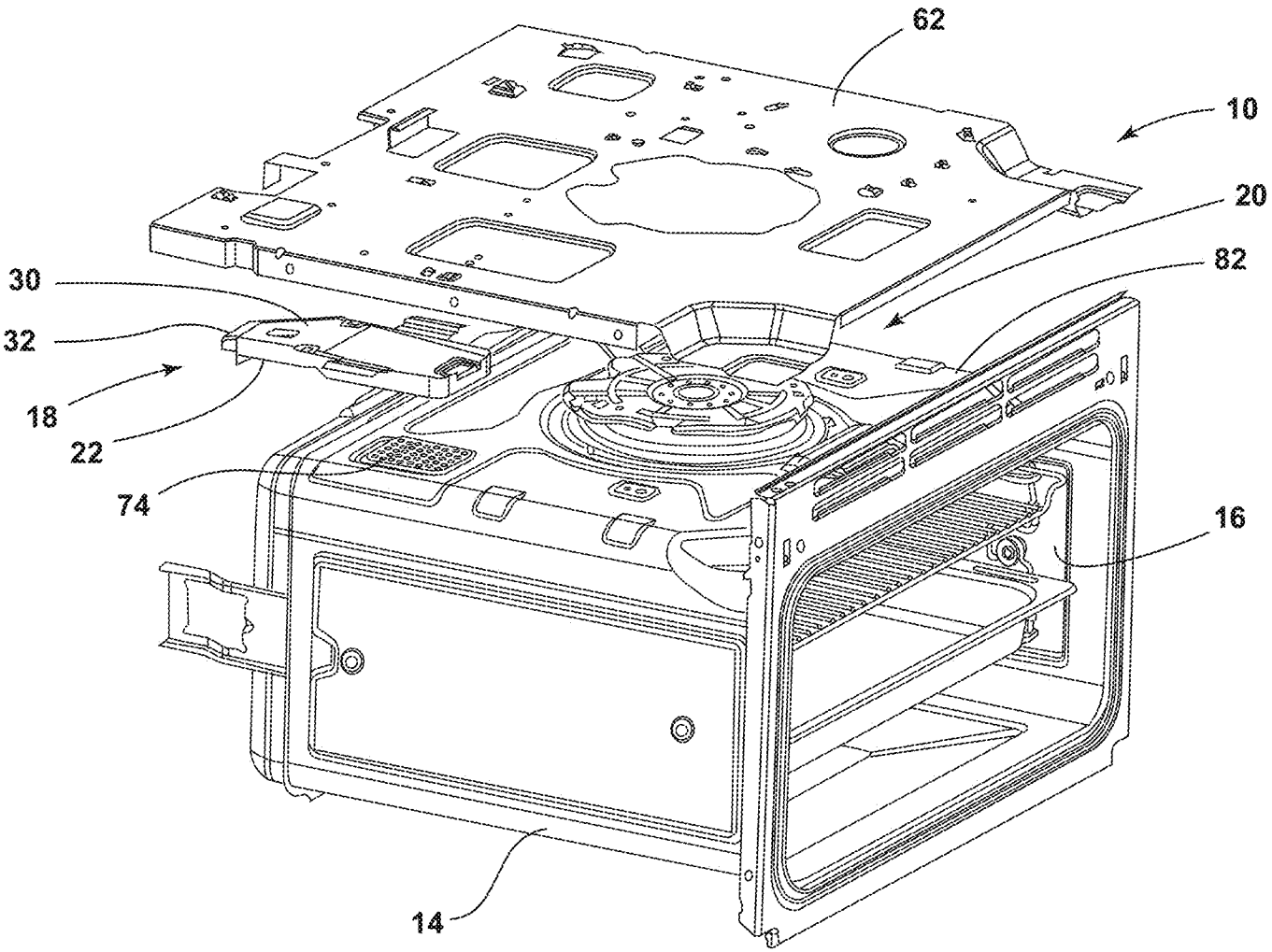
FIG. 2 is a partially exploded, side perspective view of a cooking appliance with a chimney duct assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a chimney duct assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-8, reference numeral 10 generally designates a cooking appliance. The cooking appliance 10 includes a body 12. A cavity housing 14 is disposed in the body 12 and defines a cooking cavity 16. A chimney duct assembly 18 is disposed in a space 20 defined between the body 12 and the cavity housing 14. The chimney duct assembly 18 includes a chimney base 22. An inlet 24 is defined by a bottom section 26 of the chimney base 22. A base flange 28 is coupled to the chimney base 22. The base flange 28 biases the chimney base 22 towards the cavity housing 14. A chimney top cover 30 is disposed over and operably coupled to the chimney base 22. An outlet 32 is defined between the chimney base 22 and the chimney top cover 30. The inlet 24 and the outlet 32 are in fluid communication with the cooking cavity 16 for venting. A cover flange 34 is coupled to the chimney top cover 30. The cover flange 34 biases the chimney top cover 30 towards the body 12.

Referring to FIG. 1-4, the cooking appliance 10 is illustrated, which may be an oven, such as a convection oven, a steam oven, a microwave oven, and/or a conventional oven. In the illustrated example, the cooking appliance 10 is a conventional oven that includes the body 12, such as a chassis, and the cavity housing 14 disposed within the body 12. In additional non-limiting examples, the cooking appliance 10 may include the body 12, the cavity housing 14 disposed within the body 12, and a ventilation plate 62 disposed between the body 12 and the cavity housing 14.

The oven 10 includes a door assembly 64 that selectively closes and provides access to the cooking cavity 16 to allow for the placement and removal of items to be heated into and from the cooking cavity 16. In this respect, the illustrated configuration of the door assembly 64 is merely illustrative, with it being understood that various configurations of the door assembly 64 are possible without departing from the teachings herein. Similarly, the configuration of the body 12 and the portions of the cooking cavity 16 not specifically discussed herein can vary according to the principles discussed herein and to accommodate the various features described in further detail herein.

The oven 10 is also provided with a control panel 70, which is illustrated adjacent to the door assembly 64. The control panel 70 generally includes a user interface 72, which may include one or more input elements, such as push buttons, touch switches, and the like for setting operation parameters for controlling the oven 10.

Additionally, the oven 10 is provided with a heating element for heating or cooking items, such as food stuffs, that are placed in the cooking cavity 16. The heating element, which is operable between a non-use condition and a use condition, can be configured to heat items placed in the cooking cavity 16 once the door assembly 64 is closed.

Referring still to FIGS. 1-4, as the heating element heats the inside the cooking cavity 16, the item in the cooking cavity 16 may be heated up such that moisture or vapors are emitted from the food item and accumulate within the cooking cavity 16. A blower disposed in the body 12 may then generate an airflow that directs the vapors toward a cooking cavity outlet 74. The airflow and vapors are directed through the cooking cavity outlet 74, through the inlet 24 defined on the chimney duct assembly 18, and then through the outlet 32 of the chimney duct assembly 18 to be expelled from the cooking appliance 10.

In certain aspects where a conventional oven is configured with the heating element and the blower to expel vapors from an interior cavity, the vapors can be directed out of the interior cavity but remain in the oven. In such aspects, the vapors may translate out of the interior cavity and accumulate within a chassis but outside the interior cavity. This accumulation may occur due to a lack of an airflow path that directs air out of the oven or due to a gap between an interior cavity vent and an air duct. The gap may be such that the vapors and the airflow generated by the blower are permitted to translate through the space and around the chimney duct.

To ensure that vapors are carried by an airflow and exhausted out of the oven 10, the chimney duct assembly 18 disclosed herein may be installed in the oven 10 such that an airflow path is provided between the cooking cavity 16 and an ear external to the oven 10. Additionally, the chimney duct assembly 18 may self-adjust in height such that a gap between the chimney duct assembly 18 and cooking cavity outlet 74 is reduced or eliminated, directing the airflow and vapors to be exhausted out of the oven 10, as described further herein.

Figure 3:
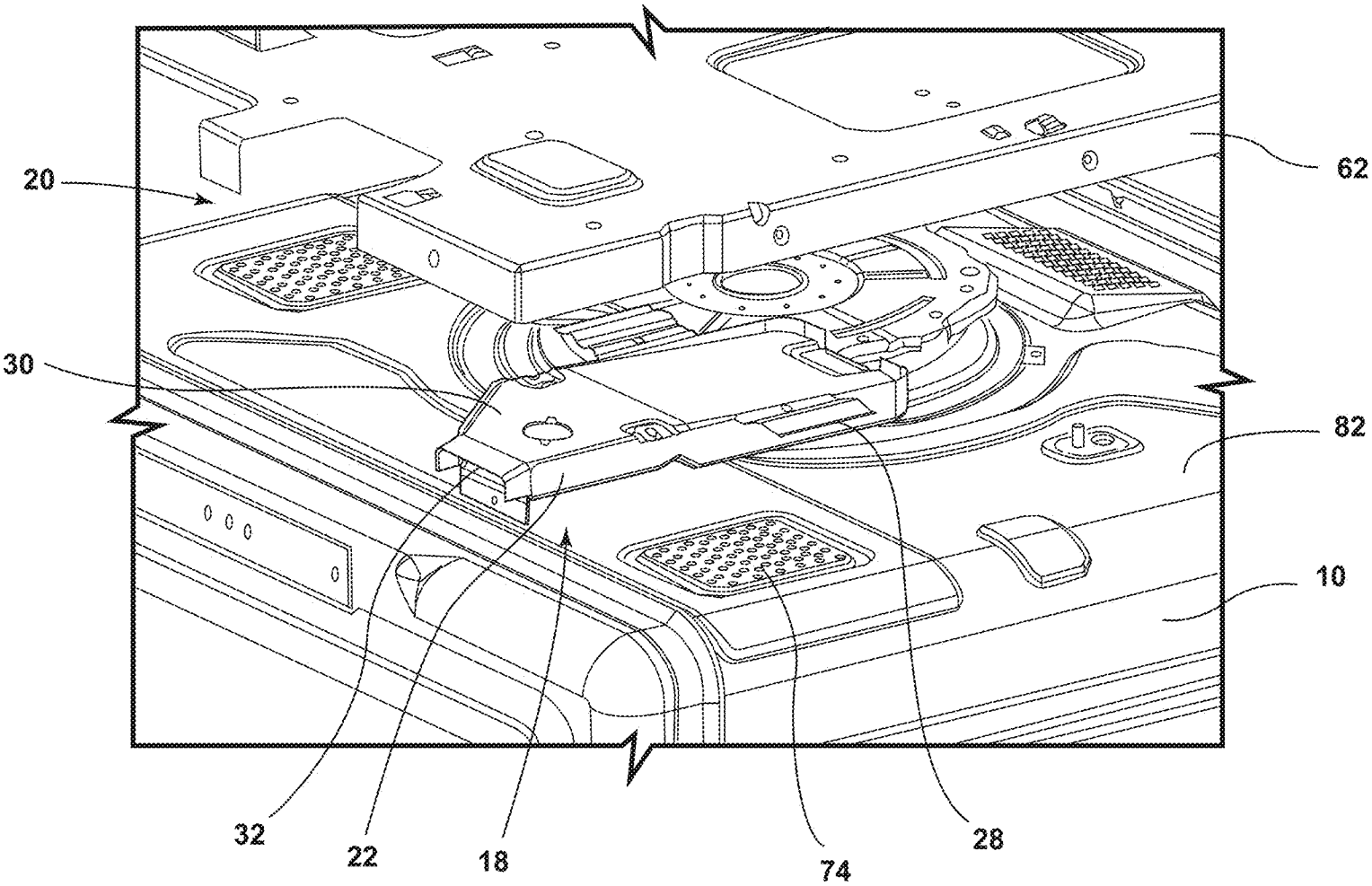
FIG. 3 is a partial partially exploded, top perspective view of a cooking appliance with a chimney duct assembly, according to the present disclosure.
Figure 4:
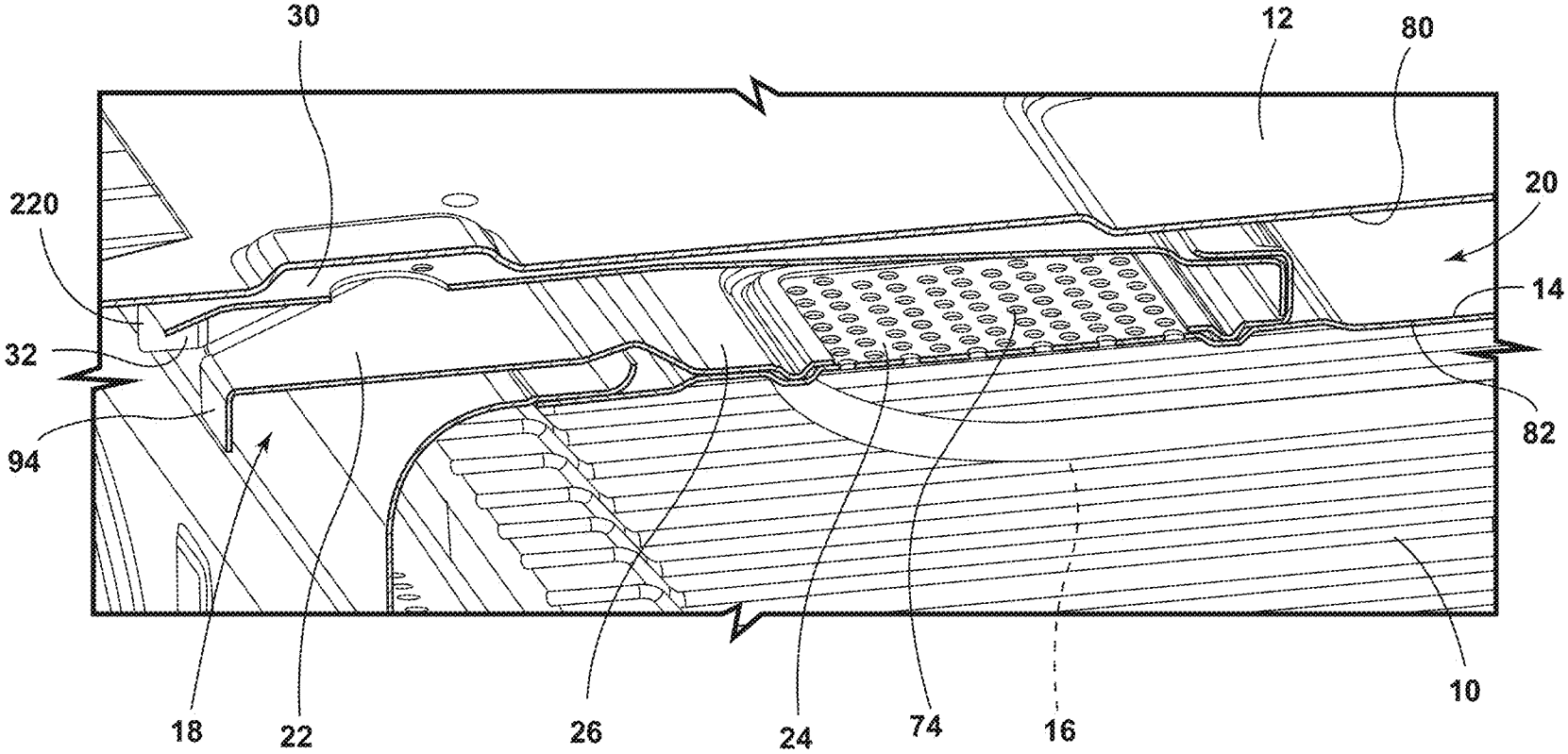
FIG. 4 is a side cross-sectional view of a chimney duct assembly disposed between a body and a cavity housing of a cooking appliance, according to the present disclosure.

Referring now to FIGS. 2-8, the chimney duct assembly 18 is shown disposed between the body 12 and the cavity housing 14. The chimney duct assembly 18 is generally disposed proximate to or over the cooking cavity outlet 74 between a top section 80 of the body 12 and a top portion 82 of the cavity housing 14. In various examples, the chimney duct assembly 18 can be disposed between the ventilation plate 62 and the top portion 82 of the cavity housing 14, such as the configuration illustrated in FIGS. 2 and 3. In such examples, the ventilation plate 62 may be disposed between the cavity housing 14 and the top section 80 of the body 12. In additional non-limiting examples, the chimney duct assembly 18 can be disposed between the top section 80 of the body 12 and the top portion 82 of the cavity housing 14. For example, the chimney duct assembly 18 can be disposed directly between the top section 80 and the top portion 82 and over the cooking cavity outlet 74, as illustrated in FIGS. 3 and 4.

According to various aspects, the chimney duct assembly 18 can be coupled to the body 12, the cavity housing 14, and/or the ventilation plate 62. In some examples, the chimney duct assembly 18 can be coupled to the top section 80 of the body 12 and the top portion 82 of the cavity housing 14. In other examples, the chimney duct assembly 18 can be coupled to the ventilation plate 62 and the top portion 82 of the cavity housing 14. Additionally, or alternatively, it is generally contemplated that the chimney duct assembly 18 can be disposed in various locations throughout the cooking appliance 10 and can be coupled to various locations throughout the cooking appliance 10.

According to various aspects, the chimney duct assembly 18 is positioned such that airflow and the vapors generated within the cooking cavity 16 are directed out of the cooking cavity 16 and then exhausted out of the body 12. In particular, the chimney duct assembly 18 can be positioned such that the inlet 24 is in fluid communication with the cooking cavity outlet 74 and the outlet 32 of the chimney duct assembly 18 extends beyond the body 12. For example, in the illustrated example shown in FIGS. 3-5, the inlet 24 is disposed vertically and directly over the cooking cavity outlet 74, and the outlet 32 extends beyond a rear section 84 of the body 12. In such examples, the vapors and airflow enter into the chimney duct assembly 18 via the inlet 24 and are then exhausted out of the chimney duct assembly 18 via the outlet 32.

Referring again to FIGS. 2-8, the chimney duct assembly 18 includes the chimney base 22. The chimney base 22 may be disposed in the space 20 defined between the body 12 and the cavity housing 14. In various examples, the chimney base 22 may be disposed between the top section 80 of the body 12 and the top portion 82 of the cavity housing 14. According to various examples, the chimney base 22 may be coupled to the top portion 82 of the cavity housing 14. In such examples, the chimney base 22 may be connected to the top portion 82 via one or more fasteners. For example, one or more snap-fit fasteners or threaded fasteners may connect the chimney base 22 to the top portion 82 of the cavity housing 14. Additionally, it is generally contemplated that the chimney base 22 may be disposed in various regions within the space 20, so long as the chimney base 22 may be in fluid communication with the cooking cavity 16, as provided herein.

As illustrated in FIGS. 3-8, the chimney base 22 includes the bottom section 26 and a sidewall 90 extending along an outer periphery of the bottom section 26. The bottom section 26 of the chimney base 22 generally abuts the top portion 82 of the cavity housing 14 and receives one or more fasteners for coupling the chimney base 22 to the top portion 82. As illustrated in FIGS. 3-8, the sidewall 90 extends towards the top section 80 of the body 12 and is generally perpendicular to the chimney base 22 such that an interior 92 is defined within the sidewall 90.

According to various aspects, the perpendicular extension of the sidewall 90 away from the chimney base 22 is such that moisture or liquid that may accumulate within the chimney base 22 is prevented from leaking out of the chimney base 22 and subsequently the chimney duct assembly 18. This moisture or liquid can instead be kept in the interior 92 and directed out of the outlet 32. The sidewall 90 can be integrally formed with the bottom section 26 or a separate component coupled to the bottom section 26. Additionally, the sidewall 90 may be integrally formed with various other components of the chimney duct assembly 18, as provided herein.

Figure 5:
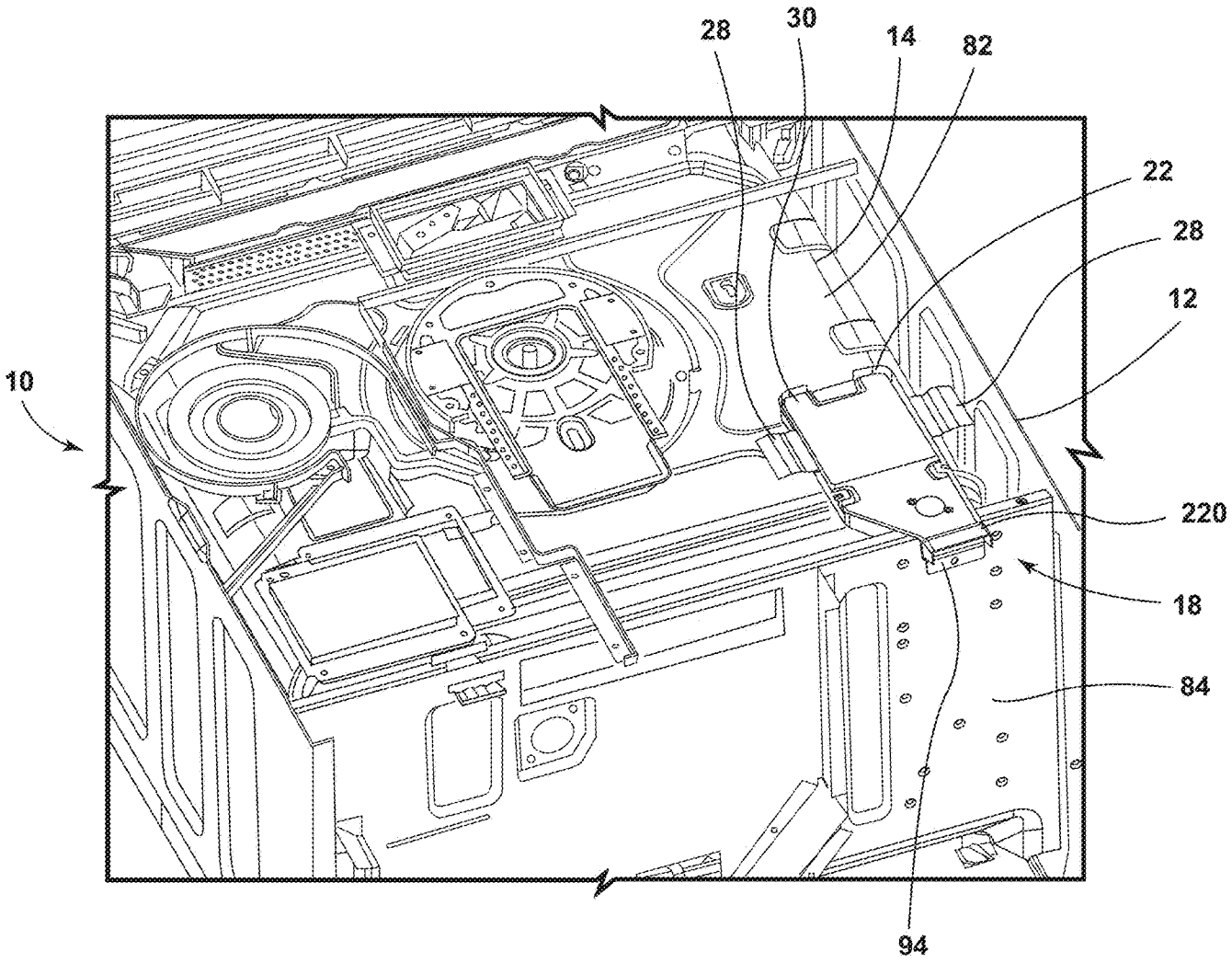
FIG. 5 is a rear perspective view of a cooking appliance with a chimney duct assembly, where a portion of an appliance body is removed, according to the present disclosure.

Referring to FIGS. 3 and 5, the inlet 24 may be defined on the bottom section 24 of the chimney base 22. The inlet 24 may be defined in various regions of the bottom section 26, such as a central region or a front region of the bottom section 26. Typically, the inlet 24 is defined proximate to the cooking cavity outlet 74 to be in fluid communication with the cooking cavity outlet 74 such that air and vapors may translate or flow from the cooking cavity 16, through the cooking cavity outlet 74, and then through the inlet 24 and into the chimney duct assembly 18. It is generally contemplated that the inlet 24 may define various shapes. For example, the inlet 24 may have a rectangular or circular shape. In additional examples, the inlet 24 may define a mating shape to the cooking cavity outlet 74 to maximize airflow into the chimney duct assembly 18. It is also generally contemplated that the inlet 24 may be defined as one or more apertures. For example, the inlet 24 may be defined as a plurality of apertures that define a mesh region on the bottom section 26. It is further contemplated that additional elements, such as a mesh or filter, may be disposed proximate and/or in fluid communication with the inlet 24.

Referring to FIGS. 3 and 5-8, the chimney base 22 includes a retaining flange 94 extending from a rear section 100 of the chimney base 22. As illustrated in FIG. 5, the retaining flange 94 may be proximate the outlet 32 and extend downward such that the retaining flange 94 abuts the rear section 84 of the body 12. According to various aspects, the retaining flange 94 is configured to assist in coupling the chimney base 22 to the top portion 82 of the cavity housing 14. Further, the retaining flange 94 may assist with inserting the chimney duct assembly 18 into the space 20 to align with the cooking cavity outlet 74.

Referring to FIGS. 2-4 and 6-8, the chimney base 22 includes the base flange 28 extending from the sidewall 90. In various examples, the chimney base 22 may include a plurality of base flanges 28, which may also be referred to as upper flanges or biasing flanges. For example, in the illustrated configuration, the chimney base 22 includes a pair of base flanges 28 extending outward from the sidewall 90.

Figure 6:
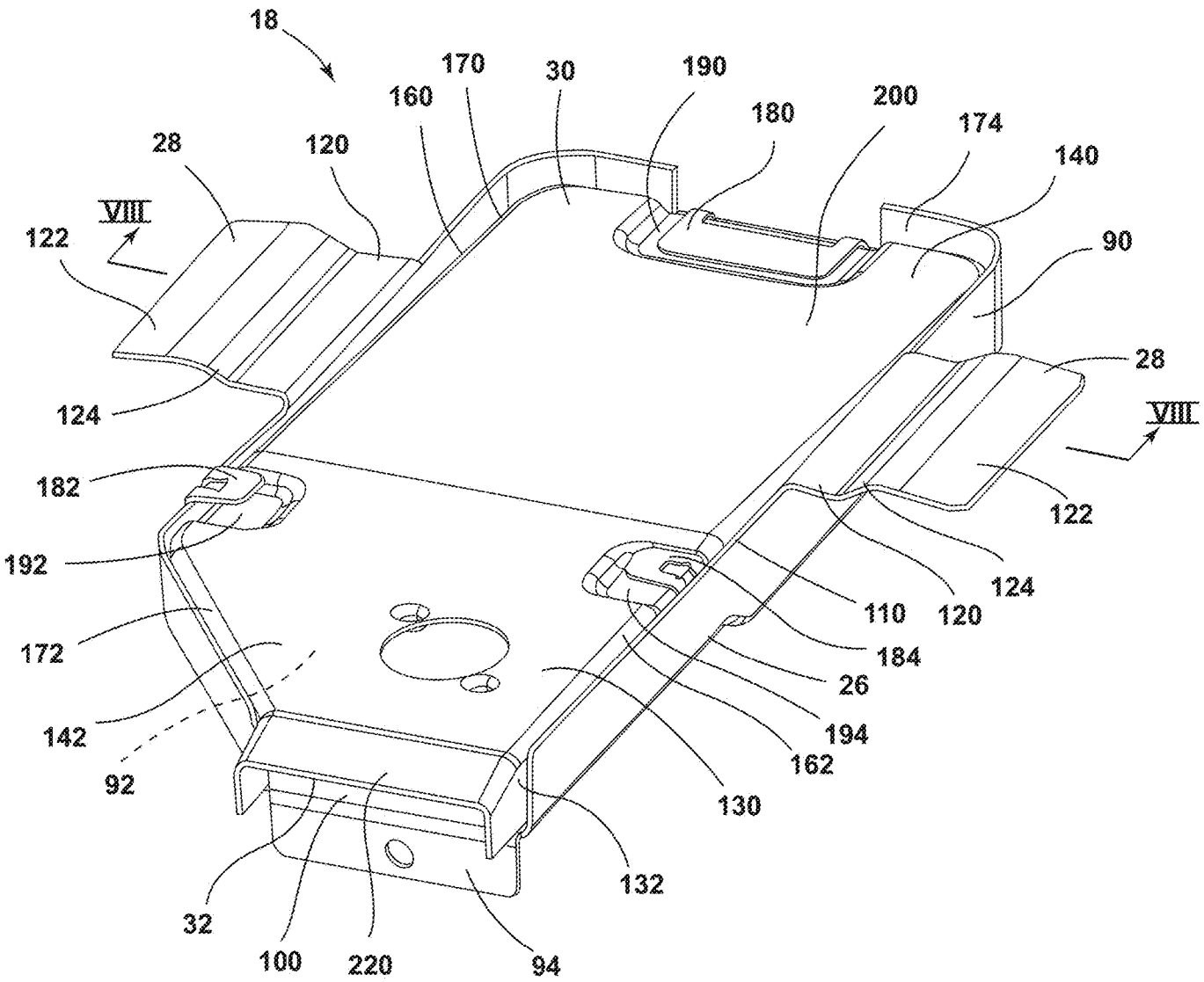
FIG. 6 is a side perspective view of a chimney duct assembly, according to the present disclosure.

Referring to FIGS. 3 and 5-8, the pair of base flanges 28 may be coupled to the sidewall 90 or may be integrally formed with the sidewall 90. For example, the base flanges 28 may be integrally formed from the sidewall 90 and extend from a top edge or a top segment 110 of the sidewall 90, as illustrated in FIG. 6. The base flange 28 may be constructed as a pair of upper biasing flanges 28 that extend outward from the sidewall 90 and toward the top section 80 of the body 12.

According to various aspects, the base flange 28 is configured to engage an upper surface, such as the top section 80 of the body 12 and/or the ventilation plate 62, and provide a biasing force that biases the chimney base 22 towards the top portion 82 of the cavity housing 14. In various examples, the base flange 28 may generate the biasing force due to a high elasticity and yield strength of the base flange 28. For example, the base flange 28 may be constructed of a spring steel such that a downward force applied to the base flange 28 results in the base flange 28 being in a stressed condition, overcoming the biasing force and generating a downward-directed biasing force on the chimney base 22.

The configuration of the base flanges 28 may contribute to the biasing force. For example, each base flange 28 may include a proximal segment 120, a distal segment 122 spaced apart from the proximal segment 120, and a stepped segment 124 between the proximal segment 120 and the distal segment 122. In various aspects, the proximal segment 120 can be coupled to the sidewall 90 of the chimney base 22 and extend outward from the sidewall 90. The proximal segment 120 may be generally perpendicular to the sidewall 90. It is also generally contemplated that the proximal segment 120 may be acutely angled or obtusely angled relative to the sidewall 90. The proximal segment 120 may be integrally formed from the sidewall 90. For example, the proximal segment 120 and the sidewall 90 may be formed from a single material or compound.

Figure 8:
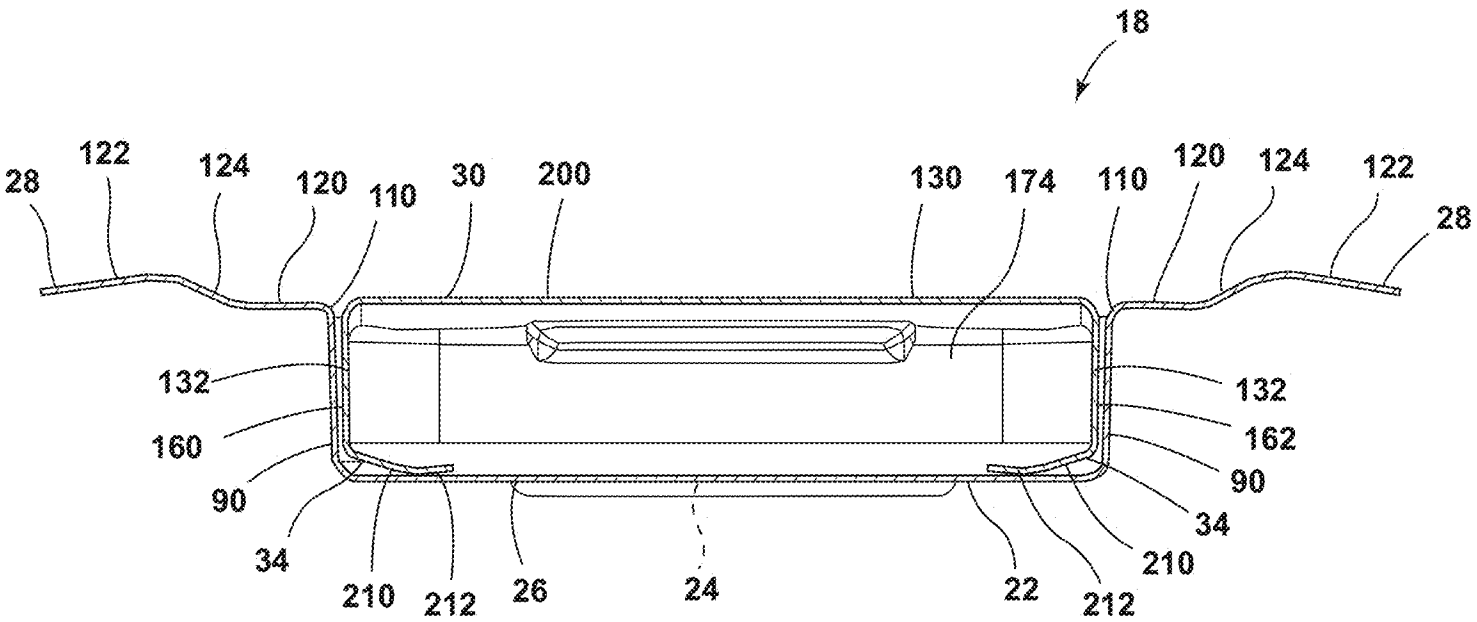
FIG. 8 is a cross-sectional view of the chimney duct assembly of FIG. 6, according to the present disclosure.

The distal segment 122, as illustrated in FIG. 8, is coupled to the proximal segment 120 via the stepped segment 124. In various examples, the distal segment 122 may be integrally formed with the stepped segment 124 or the stepped segment 124 and the proximal segment 120. For example, the base flange 28 may be constructed such that the sidewall 90, the proximal segment 120, the distal segment 122, and the proximal segment 120 are unitarily formed from a single material and form a single component.

As illustrated in FIGS. 3-8, the distal segment 122 may be angled relative to the proximal segment 120. In various examples, the distal segment 122 may be at a zero-degree angle relative to the proximal segment 120 such that the distal segment 122 and the proximal segment 120 are generally parallel. In additional examples, the distal segment 122 may be acutely angled or obtusely angled relative to the proximal segment 120.

According to various aspects, the distal segment 122 may be offset from the proximal segment 120. The offset relationship between the distal segment 122 and the proximal segment 120 is generally determined by the stepped segment 124. In particular, the offset relationship may be determined by a length of the stepped segment 124 and an angle of extension of the stepped segment 124 relative to the proximal segment 120 and/or the distal segment 122. The offset nature of the distal segment 122 and the angled proximal segment 120 allows the base flange 28 to engage the upper surface and bend or move to provide the biasing force on the chimney base 22.

It is generally contemplated that the biasing force generated by the base flange 28 may be generated via a material property of the entire base flange 28 or a portion of the base flange 28. For example, the base flange 28 may be constructed such that the proximal segment 120 and the distal segment 122 are substantially rigid and the stepped segment 124 is constructed of a spring steel. In such examples, a force on the distal segment 122 may cause the stepped segment 124 to temporarily deform such that a biasing force is generated. It is also generally contemplated that the proximal segment 120 and/or the distal segment 122 may be constructed such that each segment 120, 122 may provide a biasing force when in a stressed state. The biasing force provided by the base flange 28 is such that alignment between the cooking cavity outlet 74 and the inlet 24 is maintained and the air-tight seal is defined between the chimney duct assembly 18 and the cavity housing 14, as provided herein.

According to various aspects, the biasing force directed on the chimney base 22 is configured to assist in retaining a static engagement between the chimney base 22 and the top portion 82 of the cavity housing 14. In particular, the biasing force directed on the chimney base 22 can be such that alignment between the cooking cavity outlet 74 and the inlet 24 is maintained and the engagement between the chimney duct assembly 18 and the cavity housing 1214 defines an air-tight seal and airflow is prevented from circumventing the chimney duct assembly 18 when existing the cooking cavity outlet 74.

It is generally contemplated that the chimney base 22 may include a plurality of biasing flanges 28. For example, the chimney base 20 may include a pair of biasing flanges 32 extending outward from the sidewall 22. It is also generally contemplated that the chimney base 22 may include a plurality of biasing flanges 28 in various locations along the chimney base 22, so long as a downward-directed biasing force is directed towards the chimney base 22 and biases the chimney base 22 downward and towards the cavity housing 14.

Referring again to FIGS. 2-8, the chimney duct assembly 18 includes the chimney cover 30. According to various aspects, the chimney cover 30 may be constructed as a chimney top cover 30 extending over the chimney base 22. The chimney top cover 30 can be at least partially disposed in the interior 92 of the chimney base 22 and include a covering portion 130 that opposes and can be generally parallel with the bottom section 26 of the chimney base 22. The covering portion 130 may operably engage or abut the top section 80 of the body 12 and/or the ventilation plate 62.

In various examples, the distance between the chimney top cover 30 and the chimney base 22 generally defines a total height of the chimney duct assembly 18. In various examples, the height of the chimney top cover 30 and the chimney base 22 may be determined by various factors, such as the space 20 between the top section 80 of the body 12 and the top portion 82 of the cavity housing 14, the height of a wall portion 132, the height of the sidewall 90, and other various aspects, as provided herein. Moreover, the height of the chimney duct assembly 18 may be dynamic or adjustable based on various factors.

Figure 7:
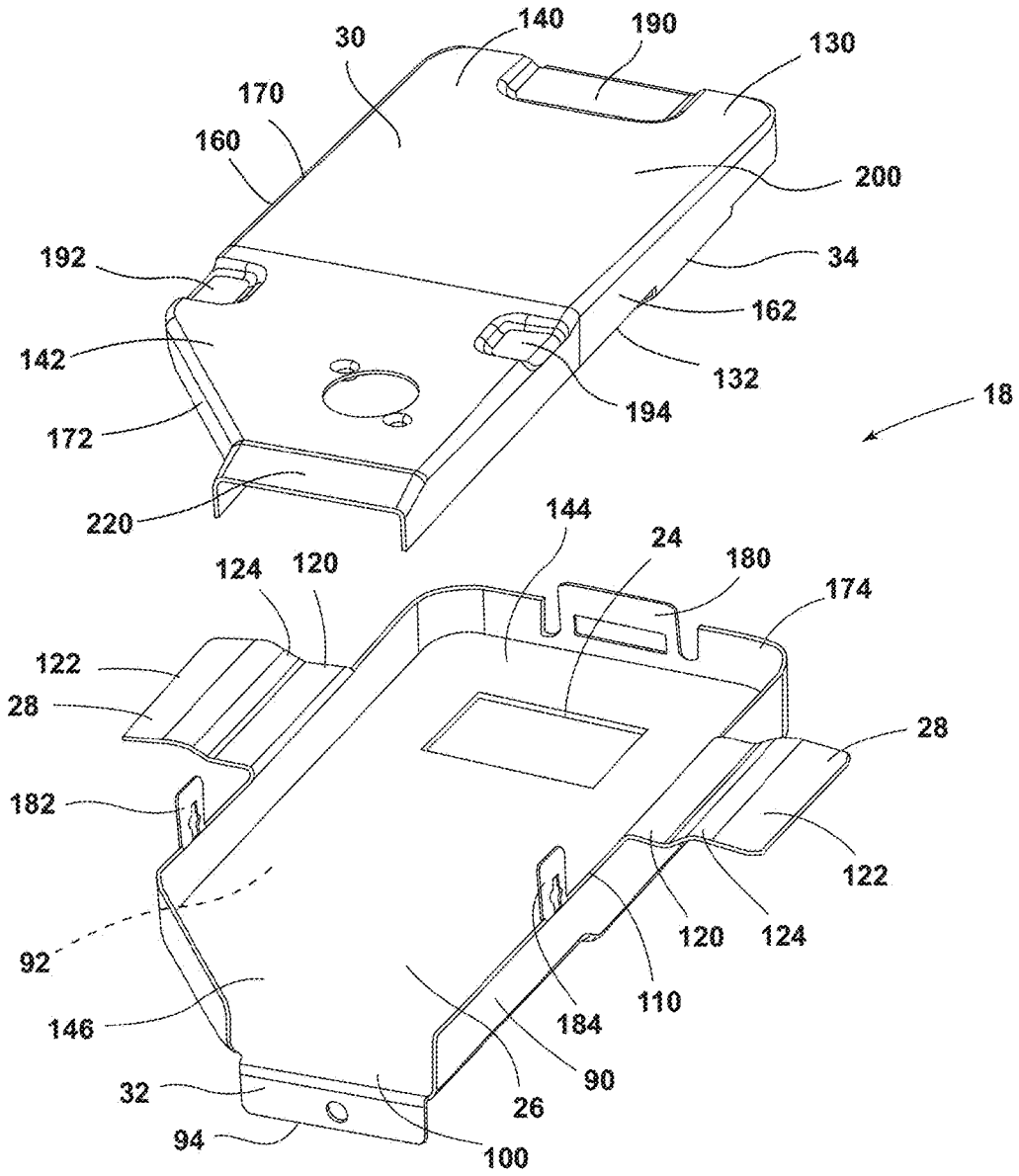
FIG. 7 is an exploded, side perspective view of a chimney duct assembly, according to the present disclosure.

According to various aspects, the covering portion 130 may include a front region 140 and a rear region 142 proximate the front region 140. As illustrated in FIGS. 6 and 7, the front region 140 may be proximate a front segment 144 of the chimney base 22 and the rear region 142 may be proximate the rear segment 146 of the chimney base 22 and the outlet 32. The front region 140 and the rear region 142 may both define a shape that coincides with a shape of the chimney base 22. For example, the front region 140 may define a rectangular shape that coincides with a rectangular shape of the rear segment 146, and the rear region 142 may taper towards the outlet 32 as the rear segment 146 tapers towards the outlet 32.

Referring again to FIGS. 7 and 8, the chimney top cover 30 generally includes the wall portion 132 that extends at least partially along an outer periphery of the covering portion 130. In various examples, the wall portion 132 may be constructed as a wall or panel that extends away from the covering portion 130 and toward or into the interior 92 of the chimney base 22. In various examples, the wall portion 132 may extend generally perpendicular from the covering portion 130 such that the wall portion 132 is generally parallel with the sidewall 90.

According to various aspects, the wall portion 132 may include a first side section 160 and a second side section 162 opposing the first side section 160. Both the first side section 160 and the second side section 162 may extend from a front end of the chimney top cover 30 and towards the outlet 32, as illustrated in FIGS. 7 and 8. The first side section 160 and the second side section 162 may both define a height that varies along a depth of the chimney top cover 30. For example, the height of the first side section 160 and the second side section 162 may gradually increase as both side sections 160, 162 approach the outlet 32. In such examples, the gradual increase in height can result in the covering portion 130 being angled towards the outlet 32 and the front region 140 being a closer distance to the bottom section 26 than the rear region 142.

Referring further to FIGS. 6-8, the first side section 160 may further include a first segment 170 and a second segment 172. As illustrated in FIG. 6, the first segment 170 extends from a front section 174 of the chimney base 22 and towards the second segment 172 and is generally parallel with the second side section 162. The second segment 172 is defined between the first segment 170 and the outlet 32. In various examples, the second segment 172 extends towards the second side section 162 and/or the outlet 32 such that the chimney top cover 30 tapers towards the outlet 32. In such examples, the second segment 172 may maintain a generally parallel relationship with the sidewall 90. For example, the sidewall 90 may first extend from the front section 174 and along the first segment 170, and then the sidewall 90 may extend along the second segment 172 and towards the second side section 162. This configuration may assist in guiding the airflow toward and through the outlet 32.

The chimney top cover 30 may be coupled to the chimney base 22 via one or more tabs 180, 182, 184. According to various aspects, the tabs 180, 182, 184 can be coupled to the sidewall 90 or be integrally formed with the sidewall 90. Each tab 180, 182, 184 is movable between a disassembled condition and an assembled condition. In the disassembled condition, as illustrated in FIG. 7, each tab 180, 182, 184 extends upward from the chimney base 22 such that insertion of the chimney top cover 30 into the interior 92 of the chimney base 22 is permitted.

As illustrated in FIG. 6, the tabs 180, 182, 184 can be moved or bent downward to the assembled condition, where each tab 180, 182, 184 extends inward from the sidewall 90 and engages with or abuts the covering portion 130 of the chimney top cover 30. In such examples, the chimney top cover 30 can be coupled to the chimney base 22 via abutment with the first tab 180 that extends inward from the sidewall 90 and engages with the front region 140 of the covering portion 130, and abutment with the second tab 182 and the third tab 184 that extends inward from the sidewall 90 and engage opposing sides of the rear region 142.

In additional non-limiting examples, the first tab 180 may engage with the front region 140, and the second tab 182 and the third tab 184 may be spaced apart from the rear region 142. In such examples, the first tab 180 may be configured to couple the chimney top cover 30 to the chimney base 22, and the second tab 182 and the third tab 184 may be configured to define a maximum height, or height threshold, of the chimney top cover 30 relative to the chimney base 22. Additionally, it is generally contemplated that the chimney duct assembly 18 may include varying numbers of tabs or various sizes, thicknesses, shapes, and placement, so long as the chimney top cover 30 may be coupled to and movable relative to the chimney base 22.

As illustrated in FIG. 6, the tabs 180, 182, 184 may be selectively disposed within recessed regions 190, 192, 194 defined on the covering portion 130, respectively. In such examples, the degree of recession of each recessed region 190, 192, 194 relative to a top surface 200 of the chimney top cover 30 may be such that each tab 180, 182, 184 is located at or below the top surface 200 of the chimney top cover 30 when abutting the chimney top cover 30.

Additionally, it is generally contemplated that each recessed region 190, 192, 194 may have a bottom surface with a slope that either coincides or is counter to a slope of the first side section 160 and the second side section 162. For example, the covering portion 130 of the chimney top cover 30 may be sloped and angled relative to the chimney base 22 due to the first side section 160 and the second side section 162 gradually increasing in height as each section 160, 162 approaches the outlet 32. To ensure that each tab 180, 182, 184 operably contacts the covering portion 130 and engages with the chimney top cover 30, the bottom surface or each recessed region 190, 192, 194 may be sloped counter to the slope of the covering portion 130 such that a generally flat surface is provided for each tab 180, 182, 184 to engage.

Referring to FIG. 8, the chimney top cover 30 includes the cover flange 34 extending from the wall portion 132. In various examples, the chimney top cover 30 may include a plurality of cover flanges 34, which may also be referred to as biasing flanges or lower flanges. For example, the chimney top cover 30 may include a pair of cover flanges 34 extending from the wall portion 132. As illustrated in FIG. 8, the pair of cover flanges 34 may be coupled to the first side section 160 and the second side section 162 of the wall portion 132, or the pair of cover flanges 34 may be integrally formed from the first side section 160 and the second side section 162, respectively. The pair of cover flanges 34 generally extend inward toward one another.

In other examples, the chimney top cover 30 may include a single cover flange 34 extending along an outer periphery of the covering portion 130. For example, the single cover flange 34 may continuously extend from a wall portion 132 that is defined as a single section that begins at a side of the outlet 32, extends around the outer periphery of the covering portion 130, and ends at an opposing side of the outlet 32.

According to various aspects, the cover flange 34 is configured to abut the bottom section 26 of the chimney base 22 and provides a biasing force that biases or directs the chimney top cover 30 away from the chimney base 22 and towards the top section 80 of the body 12. In various examples, the biasing force may be configured to direct the chimney top cover 30 upward until the chimney top cover 30 abuts the top section 80 of the body 12 and/or the second tab 182 and the third tab 184. In such examples, the distance between the chimney top cover 30 and the chimney base 22, or the total height of the chimney duct assembly 18, may be at least partially determined by the degree of biasing provided by the cover flange 34, the space 20 between the top section 80 of the body 12 and the top portion 82 of the cavity housing 14, the space 20 between the ventilation plate 62 and the top portion 82, or by the placement of the tabs 180, 182, 184.

In various examples, the cover flange 34 may generate the biasing force due to one or more material properties of the cover flange 34. For example, the cover flange 34 may have a high elasticity and yield strength that results in the cover flange 34 having a high spring tension. In such examples, the cover flange 34 may be constructed of a spring steel such that a downward force applied in the cover flange 34 results in an upward-directed biasing force on the chimney top cover 30. It is also generally contemplated that the chimney top cover 30 may include a plurality of lower biasing flanges 34 in various locations, so long as a biasing force directed upward is generated when a downward force is applied to the chimney top cover 30.

As illustrated in FIG. 8, similar to the base flange 28, the configuration of the cover flange 34 may contribute to the biasing force. The cover flange 34 may include a proximal portion 210 and a distal portion 212 extending from the proximal portion 210. In various examples, the proximal portion 210 may extend inward from the wall portion 132 of the chimney top cover 30. In such examples, the proximal portion 210 may be coupled to or integrally formed with the first side section 160 and/or the second side section 162 of the wall portion 132. Further, in such examples, the proximal portion 210 can extend at an angle relative to the first side section 160 and/or the second side section 162. For example, a proximal portion 210 extending from the first side section 160 and a proximal portion 210 extending from the second side section 162 may both extend toward the bottom section 26 of the chimney base 22.

According to various aspects, the angled and inward extension of the proximal portion 210 can provide a joint in which the cover flange 34 may flex when a compression force is applied to the chimney top cover 30. In such examples, the angled and inward extension of the proximal portion 210 can likewise permit flexing of the cover flange 34 while maintaining rigidity in the wall portion 132. In additional aspects, the angled and inward extension of the proximal portion 210 can serve to aid in the insertion of the chimney top cover 30 into the interior 92 of the chimney base 22. In particular, the proximal portion 210 may contact the sidewalls 90 during insertion and the angled extension of the sidewalls 90 may guide the chimney top cover 30 into the interior 92. Additionally, the angled and inward extension of the proximal portion 210 can serve to direct moisture that may accumulate towards the bottom section 26 of the chimney base 22 and out of the outlet 32.

The distal portion 212, as illustrated in FIG. 8, is coupled to and extends from the proximal portion 210. In various examples, the distal portion 212 may be constructed such that the proximal portion 210 and the distal portion 212 are formed from a single material and form a single component. As illustrated in FIG. 8, the distal portion 212 extends inward from the proximal portion 210 and can be acutely or obtusely angled relative to the proximal portion 210. In other examples, the distal portion 212 may extend inward from the wall portion 132 and be generally parallel with the bottom section 26 of the chimney base 22. For example, the cover flange 34 may be constructed such that the proximal portion 210 angularly extends inward from the wall portion 132 and towards the bottom section 26 and the distal portion 212 then extends inwardly and angled from the proximal portion 210. The angle of extension of the distal portion 212, in such examples, may then be obtusely angled relative to the proximal portion 210 and generally parallel with the bottom section 26.

According to various aspects, the distal portion 212 abuts the bottom section 26 of the chimney base 22. In particular, the distal portion 212 abuts and biases against the bottom section 26 such that an upward-directed biasing force is generated. In some examples, the contact between the distal portion 212 and the bottom section 26 is such that a seal is defined that prevents airflow and vapors from traveling around the distal portion 212, and out of the chimney top cover 30.

According to various aspects, the biasing force generated by the cover flange 34 may be generated via a material property of the entire cover flange 34 or a portion of the cover flange 34. For example, the cover flange 34 may be constructed such that the proximal portion 210 is constructed of a spring steel and the distal portion 212 is substantially rigid. In such examples, contact between the distal portion 212 and the bottom section 26 generates a force on the distal portion 212. The force may cause the proximal portion 210 to temporarily deform such that the biasing force is generated.

It is also generally contemplated that the proximal portion 210 and/or the distal portion 212 may be constructed such that each portion 210, 212 may provide the biasing force when in a stressed state. Additionally, it is further contemplated that the cover flange 34 may have a spring tension and provide a biasing force that is generally equal or unequal to the spring tension and biasing force provided by the base flange 28. For example, the chimney duct assembly 18 may be constructed such that the base flange 28 has a greater spring tension than the cover flange 34. For example, the chimney base 22 can be constructed such that the base flange 28 and the tabs 180, 182, 184 are each integrally formed from the sidewall 90 and share a consistent elasticity and yield strength. The cover flange 34 may then have a lesser spring tension to ensure the biasing force generated by the cover flange 34 does not overcome the retaining force provided by the tabs 180, 182, 184. Moreover, the base flanges 22 on opposing sections of the sidewall 90 may be aligned with one another and the cover flanges 34 on opposing side sections 160, 162 may be aligned with one another to provide even biasing forces on each lateral side of the chimney duct assembly 18.

Referring again to FIGS. 6 and 7, the chimney top cover 30 may include an exhaust cover 220 connected to the rear region 142. The exhaust cover 220 can extend outward from the rear region 142 and be integrally formed with the covering portion 130 of the chimney top cover 30. As illustrated in FIG. 6, the exhaust cover 220 may at least partially form or extend along the periphery of the outlet 32, as illustrated in FIG. 6. According to various aspects, the exhaust cover 220 is configured to assist in directing air and vapors out of the oven 10.

The outlet 32 is defined at an intersection between the chimney base 22 and the chimney top cover 30. The outlet 32 can be defined at an end of the rear region 142 of the chimney top cover 30 and the rear section 100 of the chimney base 22. In particular, the outlet 32 may be defined between the retaining flange 94 and the exhaust cover 220, as illustrated in FIG. 6. According to various aspects, the outlet 32 is a venting outlet that is in fluid communication with the cooking cavity outlet 74 and the inlet 24 such that airflow and vapors may flow from the cooking cavity 16, through the cooking cavity outlet 74, through the inlet 24, and through the outlet 32. The outlet 32 is then configured to permit transmission of the airflow and vapors through the outlet 32 such that the airflow and vapors are exhausted into an environment surrounding the oven 10. Additionally, or alternatively, it is generally contemplated that the outlet 32 may define various sizes and shapes, and may be defined in various locations throughout the chimney duct assembly 18, so long as the outlet 32 permits exhaustion of air and vapors out of the oven 10.

Referring to FIGS. 1-8, the chimney duct assembly 18 provides the cooking appliance 10 with an exhaust system that can readily assemble and self-adjust in height. This efficiency of assembly and self-adjustment of the chimney duct assembly 18 further permits the implementation of the chimney duct assembly 18 into various forms of ovens 10 of various sizes.

In particular, the use of the chimney base 22 and the chimney top cover 30 in assembling the chimney duct assembly 18 permit an efficient assembly process during manufacturing. By way of example, the chimney duct assembly 18 can be assembled by first disposing the chimney base 22 in the space 20 between the top section 80 of the body 12 and the top portion 82 of the cavity housing 14 and aligning the inlet 24 over the cooking cavity outlet 74. One or more base flanges 28 can then be bent upward and coupled to the top section 80 of the body 12. As the base flanges 28 are bent upward and coupled to the top section 80, the base flanges 28 are placed in the stressed state, which then generates the biasing force that acts upon the chimney base 22 and assists in keeping the chimney base 22 engaged with the top portion 82 and aligned with the cooking cavity outlet 74. The retaining flange 94 may also be coupled to the rear section 84 of the body 12 via one or more fasteners.

The chimney top cover 30 may be inserted into the interior 92 defined by the sidewall 90. As the chimney top cover 30 is inserted into the chimney base 22, the chimney top cover 30 may be compressed such that the cover flanges 34 contact the bottom section 26 of the chimney base 22, and the cover flanges 34 bend and are in the stressed state. One or more of the tabs 180, 182, 184 can be folded to the assembled condition and be positioned to abut the covering portion 130 of the chimney top cover 30. The stressed state of the cover flanges 34 results in an opposing biasing force that directs the chimney top cover 30 upward until the covering portion 130 abuts one or more of the tabs 180, 182, 184, the ventilation plate 62, or the top section 80 of the body 12.

Furthermore, the spring tension and biasing force provided by the base flange 28 and the cover flange 34 permit self-adjustment in height between the chimney base 22 and the chimney top cover 30. The self-adjustment in height of the chimney duct assembly 18 further provides for greater variance in the implementation of the chimney duct assembly 18 to various devices and in greater variance in tolerances and tolerance stacking of various components of the oven 10. For example, the chimney duct assembly 18 may be disposed in either a first oven where the top section 80 of the body 12 and the top portion 18 of the cavity housing 14 are a lesser distance from one another, or a second oven where the top section 80 and the top portion 18 are a greater distance from one another. In either oven, the biasing force produced by the base flange 28 and the cover flange 34 is such that the chimney base 22 engages both the top section 80 and the top portion 18 and the chimney top cover 30 will be biased away from the chimney base 22.

The base flange 28, the cover flange 34, and the generated biasing forces also provide air-tight interfaces that prevent fluid leaks. In particular, the downward-directed biasing force generated by the base flange 28 onto the chimney base 22 provides an air-tight seal between the inlet 24 and the cooking cavity outlet 74 such that airflow and vapors may not escape around the chimney duct assembly 18. The interaction between the cover flange 34 and the bottom section 26 of the chimney base 22 likewise defines an air-tight seal between the distal portion 212 and the bottom section 26 that minimizes or prevents airflow and vapors from escaping around the cover flange 34 and out of the chimney top cover 30. Additionally, the inward and angled extension of the cover flange 34 provides a structure that guides any built-up condensation that may occur towards the bottom section 26 and out of the outlet 32.

The use of the presently disclosed device may provide for a variety of advantages. For example, the efficient assembly of the chimney duct assembly 18 allows for rapid installation of the chimney duct assembly 18 into a cooking appliance 10. In particular, the use of the chimney base 22 with one or more base flanges 28 and tabs 180, 182, 184, and the insertion of the chimney top cover 30 with one or more cover flanges 34 into the chimney base 22 provides for an efficient installation in different oven configurations. Additionally, the presently disclosed device provides for other advantages in manufacturing. For example, the implementation of the biasing base flange 28 and cover flange 34 allows for self-adjustment in height of the chimney duct assembly 18. In particular, the biasing base flange 28 provides the biasing force that directs the chimney base 22 towards the cavity housing 14, while the biasing cover flange 34 provides the biasing force that directs the chimney top cover 30 upwards and against the tabs 180, 182, 184, the ventilation plate 62, and/or the top section 80 of the body 12. The biasing forces provided by both flanges 28, 34 ensure that both the chimney base 22 and the chimney top cover 30 will be operably disposed at the farthest possible points from each other 22, 30 in the space 20 provided. Further, the self-adjustment in height provided by the chimney duct assembly 18 advantageously allows for greater variation in the space 20 defined between the body 12 and the cavity housing 14. This greater variation in space 20 in turn allows for the implementation of the chimney duct assembly 18 into various forms of ovens and for greater variance in tolerance and in tolerance stacking of the various forms of ovens.

Once assembly is completed, the use of the presently disclosed device may provide for various other advantages. For example, the use of the chimney base 22 with the sidewall 90 that extends upward from the chimney base 22 and encompasses the wall portion 132 of the chimney top cover 30 provides for a structure that minimizes or prevents condensation and liquids from leaking out of the chimney duct assembly 18. Additionally, the biasing forces generated by the base flange 28 and the cover flange 34 provide for an air-tight seal between the cooking cavity outlet 74 and the inlet 24, and an air-tight seal between the bottom section 26 of the chimney base 22 and the distal portion 212 of the cover flange 34. Additional benefits or advantages of using this device may also be realized or achieved.

The device disclosed herein is further summarized in the following paragraphs and is further characterized by combinations of any and all of the various aspects described therein.

According to one aspect of the present disclosure, a cooking appliance includes a body and a cavity housing disposed in the body. The cavity housing defines a cooking cavity. A self-adjusting chimney duct assembly is disposed in a space defined between the body and the cavity housing. The chimney duct assembly includes a chimney base. An inlet is defined on a bottom section of the chimney base. A base flange is coupled to the chimney base. The base flange biases the chimney base towards the cavity housing. A chimney top cover is disposed over and operably coupled to the chimney base. An outlet is defined between the chimney base and the chimney top cover. The inlet and the outlet are in fluid communication with the cooking cavity for venting. A cover flange is coupled to the chimney top cover. The cover flange biases the chimney top cover towards the body.

According to another aspect of the present disclosure, a base flange and a cover flange are spring tensioned to bias a chimney base and a chimney top cover in opposing directions to adjust to a height of a space between a body and a cavity housing.

According to another aspect of the present disclosure, a base flange operably engages with a body and has a greater spring tension than a cover flange.

According to another aspect of the present disclosure, a chimney base includes a sidewall. A base flange defines a proximal segment extending from the sidewall, a distal segment apart from the proximal segment, and a stepped segment defined between the proximal segment and the distal segment. The distal segment abuts a top section of a body.

According to another aspect of the present disclosure, the chimney top cover includes a covering portion and a wall portion disposed along an outer periphery of the covering portion and perpendicular to the covering portion. A cover flange defines a proximal portion extending inward from the wall portion and a distal portion adjacent the proximal portion. The proximal portion is angled relative to a bottom section of a chimney base and the distal portion abuts the bottom section.

According to another aspect of the present disclosure, a sidewall at least partially encompasses an outer periphery of a wall portion.

According to another aspect of the present disclosure, a cover flange defines a proximal portion and a distal portion. The proximal portion is angled toward a bottom section of a chimney base and the distal portion abuts the bottom section to bias a chimney top cover away from the chimney base.

According to another aspect of the present disclosure, a self-adjusting chimney duct assembly further includes a retaining flange extending outward from a chimney base and is coupled to a cavity housing.

According to another aspect of the present disclosure, a chimney base includes a sidewall that extends along an outer periphery of the bottom section of the chimney base, and a self-adjusting chimney duct assembly further includes a first tab and a second tab extending inward from the sidewall. The first tab and the second tab are coupled to opposing sections of the sidewall, respectively and the first tab and the second tab abut the chimney top cover.

According to another aspect of the present disclosure, a self-adjusting chimney duct assembly further includes a third tab coupled to a sidewall and extending inward from the sidewall. The third tab extends perpendicular to a first tab and a second tab and the third tab abuts a chimney top cover.

According to another aspect of the present disclosure, a ventilation plate is disposed between a body and a cavity housing and a base flange engages with the ventilation plate and biases a chimney base towards the cavity housing.

According to another aspect of the present disclosure, a cooking appliance ventilation system includes a body having a top section. A cavity housing is disposed within the body and has a top portion. A space is defined between the top portion of the cavity housing and the top section of the body. A chimney duct assembly is disposed in the space between the cavity housing and the body. The chimney duct assembly includes a chimney base having a sidewall that defines an interior. The chimney base defines an inlet on a bottom section. A first pair of biasing flanges are coupled to the chimney base and extend outward from the sidewall. The first pair of biasing flanges operably engage with the body and bias the chimney base towards the cavity housing. A chimney top cover is disposed over and operably coupled to the chimney base. The chimney top cover has a covering portion and a wall portion. An outlet is defined between the chimney base and the chimney top cover. The outlet is in fluid communication with the inlet. A second pair of biasing flanges are coupled to the wall portion and extend inward from the wall portion. The second pair of biasing flanges bias the chimney top cover towards the body and away from the chimney base to adjust to a height of the space between the cavity housing and the body.

According to another aspect of the present disclosure, a first pair of biasing flanges have a greater biasing force than a second pair of biasing flanges.

According to another aspect of the present disclosure, a first pair of biasing flanges each defines a proximal segment extending from a sidewall and a distal segment spaced apart from the proximal segment by a stepped segment. A second pair of biasing flanges each defines a proximal portion extending inward from a wall portion and a distal portion spaced apart from the wall portion by the proximal portion. The distal portion abuts a bottom section.

According to another aspect of the present disclosure, a wall portion includes a first side section and a second side section opposing the first side section.

According to another aspect of the present disclosure, a first side section includes a first segment and a second segment extending towards a second side section to define an outlet.

According to yet another aspect of the present disclosure, a ventilation system for a cooking appliance includes a body with a top section. A cavity housing is disposed within the body. The cavity housing has a top portion and defines a cooking cavity. A chimney duct assembly is disposed between the cavity housing and the body. The chimney duct assembly includes a chimney base with a sidewall extending from a bottom section. An inlet is defined by the bottom section and is configured to align with a cooking cavity outlet defined by the cavity housing to permit an airflow from the cooking cavity. The chimney base includes upper biasing flanges extending outward from the sidewall. The upper biasing flanges operably engage with the top section and bias the chimney base towards the cavity housing. A chimney cover is disposed over and operably coupled to the chimney base. The chimney cover includes a covering portion and a wall portion extending from the covering portion. The chimney cover includes lower biasing flanges extending inward from the wall portion. The lower biasing flanges bias the chimney cover towards the top section. A venting outlet is defined between the chimney base and the chimney cover. The outlet is in fluid communication with the cooking cavity outlet and the inlet for venting the cooking cavity.

According to another aspect of the present disclosure, a chimney duct assembly further includes a pair of tabs extending inward from a sidewall. The pair of tabs are coupled to opposing sections of the sidewall, respectively and abut a chimney cover and define a maximum height of a chimney duct assembly.

According to another aspect of the present disclosure, a chimney duct assembly further includes a retaining flange that extends outward from a chimney base and is coupled to a cavity housing.

According to another aspect of the present disclosure, a wall portion of the chimney a cover extends from a front section of a chimney base to an outlet. The wall portion increases in height as the wall portion extends towards the outlet to adjust a height between a cavity housing and a body.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a body;

a cavity housing disposed in the body, the cavity housing defining a cooking cavity; and a self-adjusting chimney duct assembly disposed in a space defined between the body and the cavity housing, the self-adjusting chimney duct assembly comprising:

a chimney base, wherein an inlet is defined on a bottom section of the chimney base;

a base flange coupled to the chimney base, the base flange operably engaging with the body and biasing the chimney base towards the cavity housing;

a chimney top cover disposed over and operably coupled to the chimney base, wherein an outlet is defined between the chimney base and the chimney top cover, wherein the inlet and the outlet are in fluid communication with the cooking cavity for venting; and a cover flange coupled to the chimney top cover, the cover flange biasing the chimney top cover towards the body, wherein the base flange and the cover flange are spring tensioned to bias the chimney base and the chimney top cover in opposing directions to adjust to a height of the space between the body and the cavity housing, and wherein the base flange has a greater spring tension than the cover flange.

2. The cooking appliance of claim 1, wherein the chimney base includes a sidewall, and wherein the base flange defines a proximal segment extending from the sidewall, a distal segment spaced apart from the proximal segment, and a stepped segment defined between the proximal segment and the distal segment, and further wherein the distal segment abuts a top section of the body.

3. The cooking appliance of claim 2, wherein the chimney top cover includes a covering portion and a wall portion disposed along an outer periphery of the covering portion and perpendicular to the covering portion, and wherein the cover flange defines a proximal portion extending inward from the wall portion and a distal portion adjacent the proximal portion, and wherein the proximal portion is angled relative to the bottom section of the chimney base and the distal portion abuts the bottom section.

4. The cooking appliance of claim 3, wherein the sidewall at least partially encompasses an outer periphery of the wall portion.

5. The cooking appliance of claim 1, wherein the cover flange defines a proximal portion and a distal portion, and wherein the proximal portion is angled toward the bottom section of the chimney base and the distal portion abuts the bottom section to bias the chimney top cover away from the chimney base.

6. The cooking appliance of claim 1, wherein the self-adjusting chimney duct assembly further comprises:

a retaining flange extending outward from the chimney base and coupled to the cavity housing.

7. The cooking appliance of claim 1, wherein the chimney base includes a sidewall that extends along an outer periphery of the bottom section of the chimney base, and wherein the self-adjusting chimney duct assembly further comprises:

a first tab and a second tab extending inward from the sidewall, wherein the first tab and the second tab are coupled to opposing sections of the sidewall, respectively, and wherein the first tab and the second tab abut the chimney top cover.

8. The cooking appliance of claim 7, wherein the self-adjusting chimney duct assembly further comprises:

a third tab coupled to the sidewall and extending inward from the sidewall, wherein the third tab extends perpendicular to the first tab and the second tab, and wherein the third tab abuts the chimney top cover.

9. A cooking appliance ventilation system, comprising:

a body having a top section;

a cavity housing disposed within the body, the cavity housing having a top portion, wherein a space is defined between the top portion of the cavity housing and the top section of the body;

a ventilation plate disposed between the body and the cavity housing; and a chimney duct assembly disposed in the space between the cavity housing and the body, the chimney duct assembly comprising:

a chimney base having a sidewall defining an interior, wherein the chimney base defines an inlet on a bottom section thereof;

a first pair of biasing flanges coupled to the chimney base and extending outward from the sidewall, the first pair of biasing flanges operably engaging with the ventilation plate and biasing the chimney base towards the cavity housing;

a chimney top cover disposed over and operably coupled to the chimney base, the chimney top cover having a covering portion and a wall portion, wherein an outlet is defined between the chimney base and the chimney top cover, the outlet being in fluid communication with the inlet; and a second pair of biasing flanges coupled to the wall portion and extending inward from the wall portion, the second pair of biasing flanges biasing the chimney top cover towards the body and away from the chimney base to adjust to a height of the space between the cavity housing and the body.

10. The cooking appliance ventilation system of claim 9, wherein the first pair of biasing flanges have a greater biasing force than the second pair of biasing flanges.

11. The cooking appliance ventilation system of claim 9, wherein the first pair of biasing flanges each define a proximal segment extending from the sidewall and a distal segment spaced apart from the proximal segment by a stepped segment, and wherein the second pair of biasing flanges each define a proximal portion extending inward from the wall portion and a distal portion spaced apart from the wall portion by the proximal portion, and wherein the distal portion abuts the bottom section.

12. The cooking appliance ventilation system of claim 11, wherein the wall portion includes a first side section and a second side section opposing the first side section.

13. The cooking appliance ventilation system of claim 12, wherein the first side section includes a first segment and a second segment, the second segment extending towards the second side section to define the outlet.

14. A ventilation system for a cooking appliance, comprising:

a body having a top section;

a cavity housing disposed within the body, the cavity housing having a top portion and defining a cooking cavity; and a chimney duct assembly disposed between the cavity housing and the body, the chimney duct assembly comprising:

a chimney base having a sidewall extending from a bottom section, wherein an inlet is defined by the bottom section and configured to align with a cooking cavity outlet defined by the cavity housing to permit an airflow from the cooking cavity, and wherein the chimney base includes upper biasing flanges extending outward from the sidewall, the upper biasing flanges operably engaging with the top section and biasing the chimney base towards the cavity housing; and a chimney cover disposed over and operably coupled to the chimney base, the chimney cover including a covering portion and a wall portion extending from the covering portion, wherein the chimney cover includes lower biasing flanges extending inward from the wall portion, the lower biasing flanges biasing the chimney cover towards the top section, and wherein a venting outlet is defined between the chimney base and the chimney top cover, the venting outlet being in fluid communication with the cooking cavity outlet and the inlet for venting the cooking cavity.

15. The ventilation system of claim 14, wherein the chimney duct assembly further comprises:

a pair of tabs extending inward from the sidewall, wherein the pair of tabs are coupled to opposing sections of the sidewall, respectively, and wherein each of the pair of tabs abut the chimney cover and define a maximum height of the chimney duct assembly.

16. The ventilation system of claim 14, wherein the chimney duct assembly further comprises:

a retaining flange extending outward from the chimney base and coupled to the cavity housing.

17. The ventilation system of claim 14, wherein the wall portion of the chimney cover extends from a front section of the chimney base to the venting outlet, and wherein the wall portion increases in height as the wall portion extends towards the venting outlet to adjust to a height between the cavity housing and the body.

18. The cooking appliance of claim 1, wherein the chimney top cover includes recessed regions defined on a covering portion thereof, and wherein the self-adjusting chimney duct assembly includes tabs extending inward from a sidewall of the chimney base, the tabs being selectively disposed within the recessed regions to abut the covering portion.

19. The cooking appliance of claim 1, wherein the chimney base includes a sidewall extending from the bottom section, the sidewall defining an interior, and wherein the chimney top cover is at least partially disposed within the interior of the chimney base.

20. The cooking appliance of claim 1, wherein the chimney top cover includes an exhaust cover coupled to a rear region of a covering portion, the exhaust cover extending outward from the rear region and at least partially forming the outlet.

* * * * *